US007886514B2

(12) United States Patent
Hegan, Jr.

(10) Patent No.: US 7,886,514 B2
(45) **Date of Patent: *Feb. 15, 2011**

(54) SEWABLE FIRE RESISTANT THREAD

(75) Inventor: Robert S. Hegan, Jr., Winsted, CT (US)

(73) Assignee: Liberty Properties Management, LLC, Winsted, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/699,922

(22) Filed: Feb. 4, 2010

(65) Prior Publication Data

US 2010/0132327 A1 Jun. 3, 2010

Related U.S. Application Data

(62) Division of application No. 11/856,968, filed on Sep. 18, 2007, now Pat. No. 7,690,180.

(51) Int. Cl.
*D02G 3/02* (2006.01)

(52) U.S. Cl. ..... 57/238

(58) Field of Classification Search ..... 57/236–238
See application file for complete search history.

(56) References Cited

U.S. PATENT DOCUMENTS 4,155,394 A * 5/1979 Shepherd et al. ..... 152/527
4,159,618 A 7/1979 Sokaris
4,168,298 A 9/1979 Fitzgerald
4,430,851 A 2/1984 Sundet
4,950,540 A 8/1990 McCullough et al.
4,958,485 A 9/1990 Montgomery et al.
4,967,548 A 11/1990 Fangeat et al.
5,069,957 A 12/1991 Vandermeersch
5,141,542 A 8/1992 Fangeat et al.
5,306,556 A 4/1994 Rowland
5,396,981 A 3/1995 Ohtsuji et al.
5,415,449 A 5/1995 Kentner, Sr.
5,498,212 A 3/1996 Kumazaki
6,021,523 A 2/2000 Vero
6,145,686 A 11/2000 Stinson
6,351,933 B1 3/2002 Reuter
6,410,140 B1 6/2002 Land et al.
6,601,378 B1 * 8/2003 Fritsch et al. ..... 57/238
6,606,846 B2 8/2003 Land
6,706,381 B2 3/2004 Balaba et al.
6,718,583 B1 4/2004 Diaz
6,800,367 B2 10/2004 Hanyon et al.
6,942,726 B2 9/2005 Cook et al.
7,087,300 B2 8/2006 Hanyon et al.
7,111,445 B2 9/2006 Threlkeld et al.
7,127,879 B2 10/2006 Zhu et al.
7,690,180 B2 * 4/2010 Hegan, Jr. ..... 57/238
2001/0053819 A1 12/2001 Bersted et al.

(Continued)

*Primary Examiner*—Shaun R Hurley
(74) *Attorney, Agent, or Firm*—Hammer & Associates, P.C.

(57) ABSTRACT

A sewing thread comprising a first yarn that is a filament yarn made or a fire resistant polymer and a second yarn that is a synthetic and/or natural yarn. The sewing thread may also contain a third yarn that is a synthetic and/or natural yarn. The first, second, and third yarns each have a first twist in the same direction. The first, second, and third yarns are then combined to form the sewing thread using a second twist which is in the opposite direction of the first twist. No bonding agent is used in the sewable, fire resistant thread.

5 Claims, 2 Drawing Sheets

U.S. PATENT DOCUMENTS

2002/0144497 A1 10/2002 Scheunemann
2003/0159768 A1* 8/2003 Fritsch et al. ..... 152/556
2005/0144928 A1 7/2005 Nuesch
2005/0245647 A1 11/2005 Masuda et al.

* cited by examiner

SEWABLE FIRE RESISTANT THREAD

RELATED APPLICATION

This application is a divisional application claiming the benefit of application Ser. No. 11/856,968 filed Sep. 18, 2007 which is now issued as U.S. Pat. No. 7,690,180.

FIELD OF THE INVENTION

The present invention relates to a sewable fire resistant thread.

BACKGROUND OF THE INVENTION

It has long been a problem in the textile industry to create an inexpensive, sewable fire resistant thread. The sewing thread should allow easy movement when tension is applied and ease in needle threading; should resist friction during sewing; should have sufficient elasticity to avoid the breaking of stitches; and should have sufficient strength to hold seams during laundering or dry cleaning and in use. Threads for special uses may require appropriate treatment. Garments made of fire-resistant fabrics, for example, may be sewn with thread that has also been made fire-resistant.

Such a thread would have a variety of uses including, but not limited to: sewing mattress parts together, sewing fire fighting gear and clothing together, and sewing upholstery together. Additional uses for such a sewable thread include, but are not limited to, seat belts, air bags, cargo nets, cargo straps, and carpeting. A sewable fire resistant thread must meet the federal requirements of 16 CFR 1632 and Cal 129 in order to be used to sew the various components of a mattress together. Currently, thread comprised of Kevlar® strands throughout is employed having satisfactory results. However, Kevlar® is very expensive making a cheaper alternative economically attractive.

U.S. Pat. No. 7,111,445 discloses a fire resistant core-spun yarn which may be used as a sewing thread. The patent discloses a fire resistant composite yarn comprising an elongating central core (e.g., cotton, polyurethane, polyester, nylon), a non-elongating bottom cover (e.g., fiberglass, ceramic, or aramid fibers) over the core, and an outer cover (e.g., polyester or nylon) over the bottom cover, all of which are treated first with a bonding agent followed by treatment with a lubricant.

U.S. Pat. Nos. 6,800,367 and 7,087,300 each disclose a fire retardant and heat resistant yarns containing oxidized polyacrylonitrile fibers, high strength filaments, and/or strengthening fibers. They each disclose a fire retardant and heat resistant yarn suitable for making fabric comprised of one or more yarns wound in a spiral helix.

Hence, there exists an unsatisfied need for an inexpensive, sewable fire resistant thread.

SUMMARY OF THE INVENTION

A sewing thread comprises a first yarn that is a filament yarn made of a fire resistant polymer and a second yarn that is a synthetic and/or natural yarn. The sewing thread may also contain a third yarn that is a synthetic and/or natural yarn. The first, second, and third yarns each have a first twist in the same direction. The first, second, and third yarns are then combined to form the sewing thread using a second twist which is in the opposite direction of the first twist. No bonding agent is used in the sewable, fire resistant thread.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

DETAILED DESCRIPTION OF THE INVENTION

Figure 1:
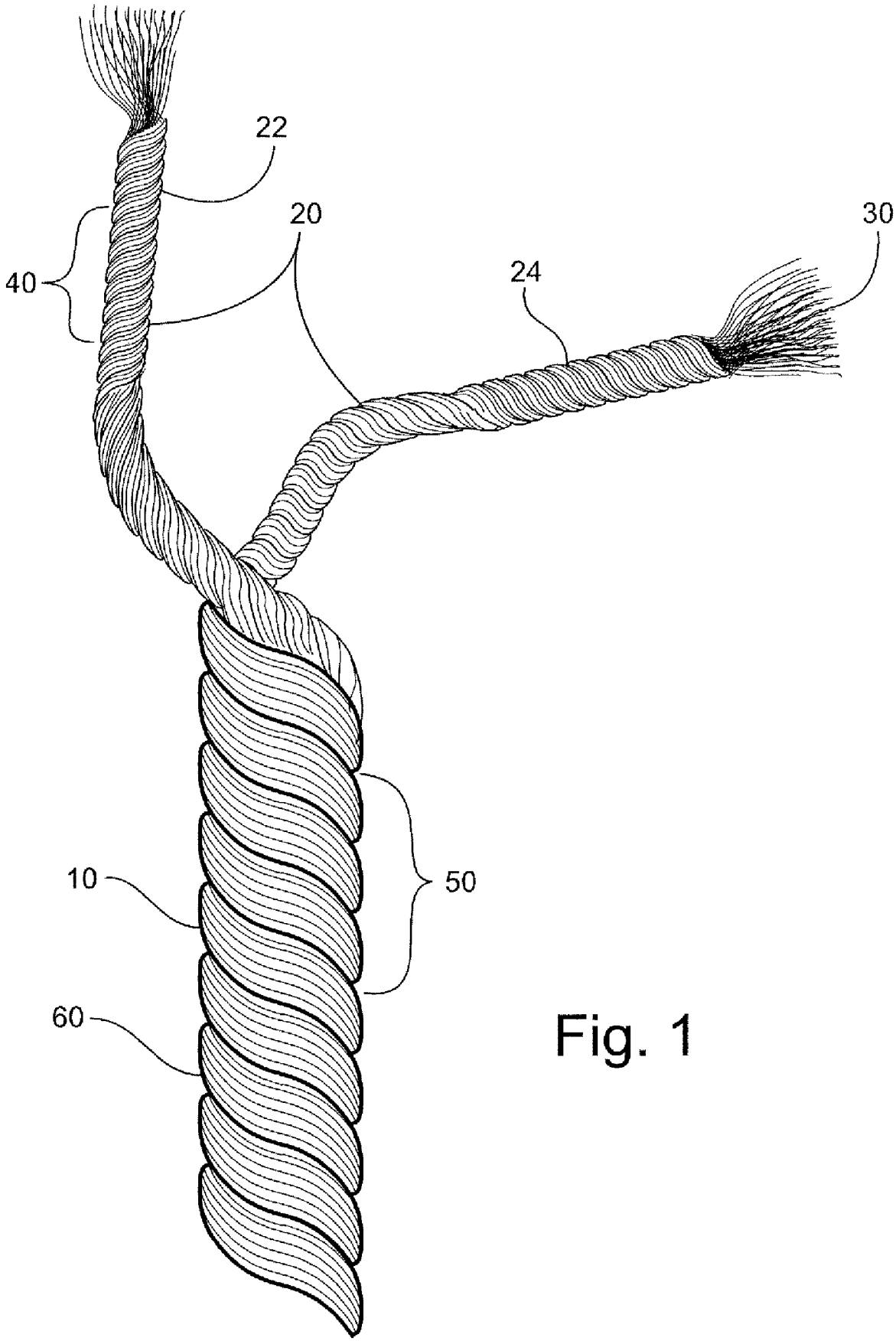
FIG. 1 illustrates an embodiment of a sewing thread.
Figure 2:
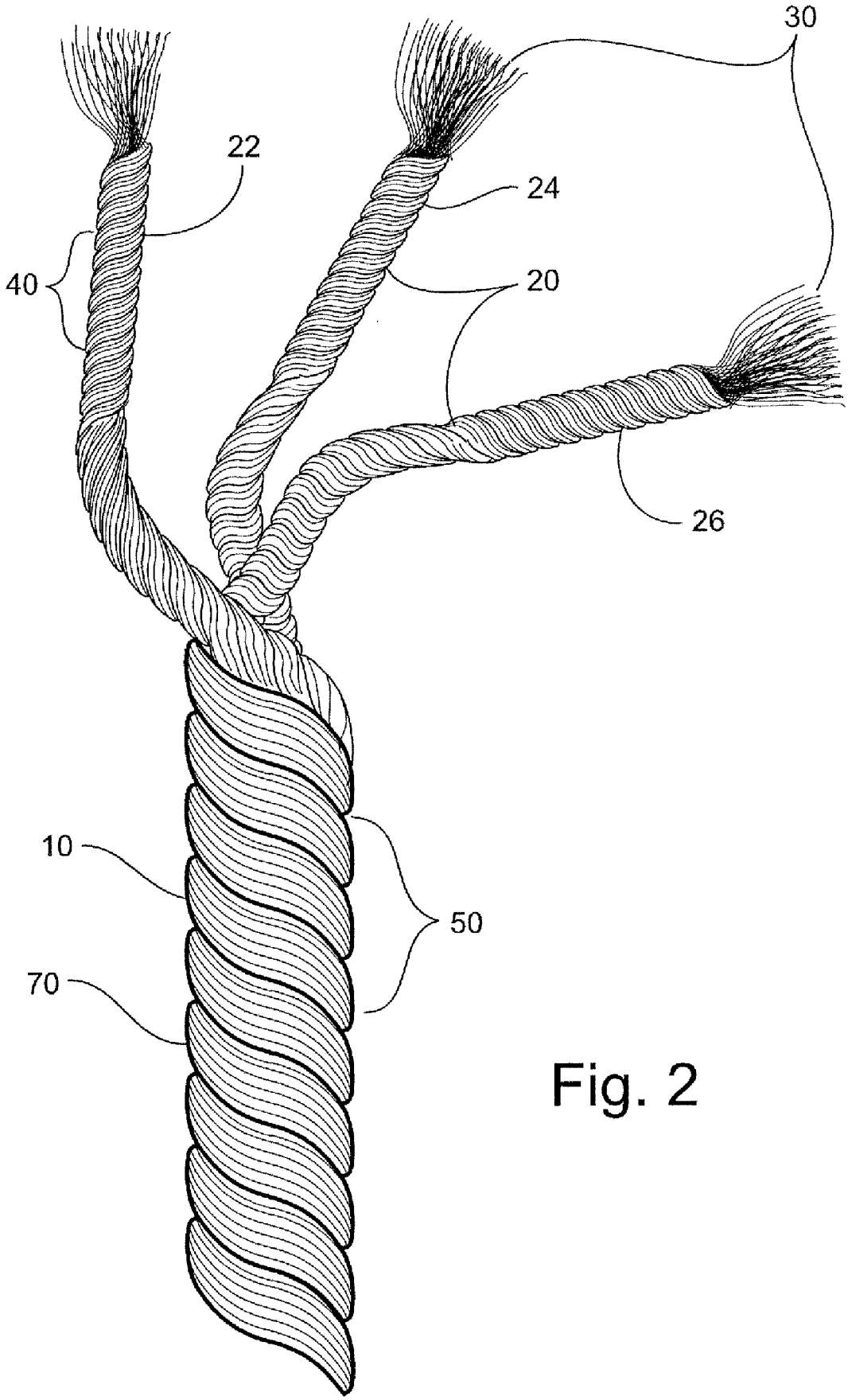
FIG. 2 illustrates an embodiment of a sewing thread.

Referring to the drawings, wherein like numerals indicate like elements, there are shown in FIGS. 1 and 2 separate embodiments of a sewing thread 10. The present invention provides an inexpensive, fire resistant sewing thread. Sewing thread 10, as used herein, refers to a thread which may be used to sew two or more fabrics together. The sewing thread may be comprised of two or more yarns 20 which may be referred to as a first yarn 22 and a second yarn 24. In one embodiment, the first yarn 22 is a filament yarn comprised of a fire resistant polymer. The second yarn 24 is comprised of a synthetic and/or natural yarn. Both the first yarn 22 and the second yarn 24 individually have a first twist in the same direction. The first 22 and second yarns 24 are then combined using a second twist which is in the opposite direction of the first twist. In another embodiment, the sewing thread 10 is further comprised of a third yarn 26. The third yarn 26 is comprised of a synthetic and/or natural yarn and shares the same first twist as the first 22 and second yarns 24. The first 22, second 24, and third 26 yarns are then combined using a second twist which is in the opposite direction of the first twist.

In yet another embodiment, the sewing thread may be a core-spun yarn comprising a first yarn being a filament yarn comprised of a fire resistant polymer being the core and a second yarn comprised of a synthetic or natural yarn and no bonding agent. Both the first yarn and the second yarn individually have a first twist in the same direction. The second yarn is wrapped around the first yarn to provide substantial coverage of the first yarn. In still another embodiment, the core spun yarn having a first and second yarn may be further comprised of a third yarn comprised of a synthetic or natural yarn and having the same first twist as the first and second yarn. The third yarn is wrapped around the second yarn in the opposite direction to provide substantial coverage of the second yarn.

Yarn 20, as used herein, refers to a strand comprised of fibers, filaments 30, or combinations thereof, either natural or synthetic, suitable for use in sewing threads. In one embodiment, the yarn may be comprised of a number of fibers twisted together. In another embodiment, the yarn 20 may be comprised of a number of filaments 30 grouped together but not twisted. In yet another embodiment, the yarn 20 may be comprised of a number of filaments 30 twisted together. In still another embodiment, the yarn 20 may be comprised of a single filament 30, called a monofilament, either with or without twist. In still another embodiment, the yarn 20 may be comprised of a combination of natural and synthetic fibers. In still another embodiment, the yarn may be comprised of a combination of natural and synthetic filaments.

Fiber, as used herein, refers to units of matter having length at least 100 times their diameter or width. Typically textile fibers are units that can be spun into a yarn by various methods including twisting. Fibers suitable for textile use possess adequate length, fineness, strength, and flexibility for yarn formation and for withstanding the intended use of the completed yarn. Other properties affecting fiber performance include, but are not limited to, elasticity, durability, uniformity, luster, crimp (waviness), moisture absorption, reaction to heat and sunlight, reaction to the various chemicals applied during processing and in the dry cleaning or laundering of the completed fabric, and resistance to insects and microorganisms. The wide variation of such properties among textile fibers determines their suitability for various uses. In one embodiment, fiber may refer to staple. In another embodiment, fiber may refer to continuous filament and/or tow.

Filament 30, as used herein, refers to a fiber of an indefinite or extreme length such as found naturally in silk. Synthetic strands are extruded into filaments that are converted into filament yarn, staple, or tow.

Yarns may be categorized into different types which include single, ply, or cord. Single, or one-ply, yarns may refer to single strands composed of fibers and or filaments held together by at least a small amount of twist. In one embodiment of the present invention, the first, second, third, or additional yarns may be filaments grouped together either with or without twist. In yet another embodiment, the first, second, third, or additional yarns may be synthetic filaments extruded in sufficient thickness for use alone as yarn (monofilaments). In yet another embodiment, the first, second, third, or additional yarns may be multifilament yarns. Single yarns of the spun type, composed of many short fibers, may be held together with a twist in either S-twist 50 or Z-twist direction 40.

Ply, plied, or folded, yarns may be composed of two or more single yarns twisted together. In one embodiment, the sewing thread may be a two-ply yarn 60 comprised of two single yarns. In another embodiment, the sewing thread may be a three-ply yarn 70 may be comprised of three single yarns. In yet another embodiment, the first, second, third or additional yarns are each twisted in one direction (e.g., the "S" direction 50) and are then combined and twisted in the opposite direction (e.g., the "Z" direction 40) to make a ply yarn. In one embodiment, the sewing thread 10 may be comprised of single yarns 20 twisted in the "S" direction" 50 which are then combined and twisted in the "Z" direction 40. In another embodiment, the sewing thread 10 may be comprised of single yarns 20 twisted in the "Z" direction" 40 which are then combined and twisted in the "S" direction 50.

Cord yarns may be produced by twisting ply yarns together, with the final twist usually applied in the opposite direction of the ply twist. In one embodiment, a sewing thread may be a cord yarn having an SZS form, with S-twisted singles made into Z-twisted plies that are then combined with an S-twist. In another embodiment, a sewing thread may be a cord yarn having a ZSZ form. In yet another embodiment, a sewing thread may be a cord yarn having an SSZ or a ZZS pattern.

Core-spun yarn, as used herein, refers to a yarn made by twisting fibers around a filament (core) of a previously spun yarn, thus concealing the core. A core spun yarn may be comprised of a core of previously spun yarn and one or more layers of yarn twisted around the core wherein each additional layer substantially covers first the previous layer.

First yarn 22, as used herein, refers to a yarn, as described above, that is a filament yarn. Filament yarn, as used herein, refers to a yarn composed of one or more continuous filaments assembled with or without a twist. In one embodiment of the present invention, the first yarn 22 may be comprised of filaments 30 having a first twist in either the "S" 50 or "Z" 60 direction, made of a fire resistant polymer. In another embodiment, the first yarn 22 may be comprised of fibers having a first twist in either the "S" 50 or "Z" 60 direction, made of a fire resistant polymer. In still another embodiment, the first yarn 22 may be a monofilament yarn. In still another embodiment, the first yarn 22 may be a multifilament yarn.

Fire resistant polymer, as used herein, refers to a polymer that does not burn at all, burns slowly, or is self-extinguishing after removal of an external source of ignition. A yarn 20 may be fire resistant because of the innate properties of the fiber/filament, the twist level of the yarn, the presence of flame retardants, or a combination thereof. In one embodiment of the present invention, the first yarn 22 may be comprised of filaments 30 made of a fire resistant polymer including, but not limited to, an aramid, a polyester polyarylate, a PBO, a melamine formaldehyde, or combinations thereof. In another embodiment of the present invention, the first yarn 20 may be comprised of fibers made of a fire resistant polymer including, but not limited to, an aramid, a polyester polyarylate, a PBO, a melamine formaldehyde, or combinations thereof. In still another embodiment, the first yarn 20 may be a polyester polyarylate yarn. In still another embodiment, the first yarn 20 may be a polyester polyarylate (e.g., Vectran made by Kuraray Co., Ltd. of Tokyo, Japan) multifilament yarn.

Second yarn 24, as used herein, refers to a yarn, as described above, that is either a synthetic yarn, a natural yarn, or a combination thereof. In one embodiment of the present invention, the second yarn 24 may be comprised of filaments 30 having a first twist in either the "S" 50 or "Z" 40 direction. In another embodiment, the second yarn 24 may be comprised of fibers having a first twist in either the "S" 50 or "Z" 40 direction. The second yarn 24 may be comprised of materials including, but not limited to, cotton, linen, alpaca, angora, mohair, llama, cashmere, silk, camel, yak, possum, qiviut, cat, dog, wolf, rabbit, buffalo hair, polyamides, polyolefins, polyesters, acrylics, cellulosics, or combinations thereof. In one embodiment of the present invention, the second yarn 24 may be a multifilament yarn. In another embodiment, the second yarn 24 may be a nylon multifilament yarn.

Synthetic yarn, as used herein, refers to a yarn comprised of synthetic fibers and/or filaments obtained from man-made sources. Synthetic fibers/filaments, as used herein, refers to fibers/filaments made of polymers that do not occur naturally but instead are produced from by-products of petroleum or natural gas. Synthetic fibers/filaments may be produced from fiber-forming substances including, but not limited to, (1) polymers synthesized from chemical compounds; (2) modified or transformed natural polymers; and (3). Synthetic fibers/filaments include, but are not limited to, polyamides, polyolefins, polyesters, acrylics, cellulosics, acetates, rayons, fiberglass, or combinations thereof.

Natural yarn, as used herein, refers to a yarn comprised of natural fibers and/or filaments obtained from non-man made sources. Natural fibers, as used herein, refers to any hair-like raw material directly obtainable from an animal, vegetable or mineral source which may be spun into a yarn. The only filament that is produced in nature is silk. Most textile fibers are slender, flexible, and relatively strong. They are elastic in that they stretch when put under tension and then partially or completely return to their original length when the tension is removed. Natural fibers include, but are not limited to, cotton, linen, alpaca, angora, mohair, llama, cashmere, camel, yak, possum, qiviut, cat, dog, wolf, rabbit, buffalo hair, or asbestos. Natural filaments include silk.

Twist, as used herein, refers to the spiral arrangement of the filament(s) and/or fibers around the axis of the yarn. Twist may be produced by revolving one of a filament/fiber strand while the other end is held stationary. The twist binds the filaments/fibers together and enhances the strength of the yarn. The direction of the twist is described as S-twist 50 and Z-twist 40. A yarn has S-twist 50 if, when held in a vertical position, the spirals conform to the direction of slope of the central portion of the letter "S". A yarn has Z-twist 40 if, when held in a vertical position, the direction of spirals conforms to the slope of the central portion of the letter "Z." In one embodiment, the twist may refer to a first twist which may be in either the "S" 50 or "Z" 40 direction. In another embodiment, the twist may refer to a second twist which may be a twist in the opposite direction as the first twist. In still another embodiment, the twist may refer to a third twist which may be a twist in either the same or the opposite direction as the first twist.

Bonding agent, as used herein, refers to a material, such as an adhesive, used to bond filaments and or fibers to one another. Bonding agents may include, but are not limited to, polyurethanes, polyethylene terephthalates, polyacrylics, nylons and other conventional fiber bonding compositions. No bonding agents are used in the present invention.

Multifilament yarn, as used herein, refers to a filament yarn, as described above, comprised of two or more filaments assembled with or without a twist.

Dyeable, as used herein, refers to the ability of a fiber, filament, thread, yarn, or combination thereof to be colored with either natural or synthetic dyes. Dyeing processes include, but are not limited to, batik, chain dyeing, cross dyeing, high-temperature dying, ingrain, jet dyeing, mass-colored, muff dyeing, package dyeing, pad dyeing, piece dyeing, pressure dyeing, reserve dyeing, short-liquor dyeing, skein dyeing, solution dyeing, solvent dyeing, space dyeing, spin-dyeing, stock dyeing, thermal fixation, union dyeing, yarn dyeing, or combinations thereof. In one embodiment of the present invention, the sewing thread is dyeable.

Denier, as used herein, refers to the weight in grams of 9,000 meters of filament or filament yarn. For example, if 9,000 meters of a yarn weigh 15 grams, it is a 15-denier yarn; if 9,000 meters of a yarn weigh 100 grams, it is a 100-denier yarn, and much coarser than the 15-denier yarn. Thus a smaller number indicates a finer yarn. In one embodiment of the present invention, the deniers of the first and second yarns are roughly equal to one another. In another embodiment, the deniers of the first, second, and third yarns are roughly equal to one another. In another embodiment, the denier for the first and second yarns is between 50 and 450. In another embodiment, the denier for the first, second, and third yarns is between 50 and 450. In still another embodiment, the denier for the first and second yarns is between 70 and 420. In still another embodiment, the denier for the first, second, and third yarns is between 70 and 420. In still another embodiment, the denier for the first, second, and third yarns is 80. In still another embodiment, the denier for the first, second, and third yarns is 200. In still another embodiment, the denier for the first, second, and third yarns is 400.

Filament count, as used herein, refers to the number of individual filaments that make up a thread or yarn. In one embodiment of the present invention, the filament count is between 30 and 75. In another embodiment, the filament count is between 34 and 68. In still another embodiment, the filament counts of the second and third yarns are roughly equal to one another. In still another embodiment, the filament count of the first yarn is substantially different to the filament counts of the second and, if applicable, third yarns. In still another embodiment, the filament count of the first yarn is roughly equal to the filament count of the second and, if applicable, third yarns.

Third yarn 26, as used herein, refers to a yarn 20, as described above, that is either a synthetic yarn, a natural yarn, or a combination thereof. In one embodiment of the present invention, the third yarn 26 may be comprised of filaments 30 having a first twist in either the "S" 50 or "Z" 40 direction. In another embodiment, the third yarn 26 may be comprised of fibers having a first twist in either the "S" 50 or "Z" 40 direction. The third yarn 26 may be comprised of materials including, but not limited to, cotton, linen, alpaca, angora, mohair, llama, cashmere, silk, camel, yak, possum, qiviut, cat, dog, wolf, rabbit, buffalo hair, polyamides, polyolefins, polyesters, acrylics, cellulosics, or combinations thereof. In one embodiment of the present invention, the third yarn 26 may be a multifilament yarn. In another embodiment, the third yarn 26 may be a nylon multifilament yarn.

Lubricant, as used herein, refers to any material used to aid the sewing thread in withstanding the heat generated as it slides through a needle eye while being sewn. The lubricant may be applied in any conventional manner, including but not limited to spraying on the fiber, rolling, or immersing the yarn into a lubricant containing bath. The lubricant may be applied as a solution in a suitable organic or aqueous solvent or neat. The preferred lubricant is a silicone with paraffin added.

Additional yarns, as used herein, refer to a yarn, as described above, that is either a synthetic yarn, a natural yarn, or a combination thereof. In one embodiment of the present invention, the additional yarn may be comprised of filaments 30 having a first twist in either the "S" 50 or "Z" 40 direction. In another embodiment, the additional yarn may be comprised of fibers having a first twist in either the "S" 50 or "Z" 40 direction. The additional yarn may be comprised of materials including, but not limited to, cotton, linen, alpaca, angora, mohair, llama, cashmere, silk, camel, yak, possum, qiviut, cat, dog, wolf, rabbit, buffalo hair, polyamides, polyolefins, polyesters, acrylics, cellulosics, or combinations thereof. In one embodiment of the present invention, the additional yarn may be a multifilament yarn. In another embodiment, the additional yarn may be a nylon multifilament yarn.

The present invention includes a method of manufacturing a sewing thread which is comprised of a series of steps. The steps include providing a first yarn which is a filament yarn made of a fire resistant polymer, and providing one or more additional yarns which are synthetic and/or natural yarns. The first yarn and the one or more additional yarns are individually twisted with a first twist which is in the same direction. The first yarn and one or more said additional yarns are then twisted together with a second twist to form said sewing thread. The second twist is in the opposite direction of the first twist. A lubricant is then added to the sewing thread.

The method of manufacturing the sewing thread may further comprise additional steps. In one embodiment, the method of manufacturing may include the step of dying the sewing thread.

The present invention also includes an alternative method of manufacturing a fire-resistant sewing thread being a core-spun sewing thread which is comprised of a series of steps. The steps include providing a first yarn which is a filament yarn made of a fire resistant polymer, and providing a second and third yarn which are synthetic and/or natural yarns. The first, second, and third yarns are individually twisted with a first twist which is in the same direction. The first yarn is the core and the second yarn is then wrapped around the first yarn in the opposite direction of the first twist to provide substantial coverage of the first yarn/core. The third yarn is then wrapped around the second yarn in the opposite direction that the second yarn was wrapped to provide substantial coverage of the second yarn. A lubricant is then added to the sewing thread.

The method of manufacturing the sewing thread may further comprise additional steps. In one embodiment, the method of manufacturing may include the step of dying the sewing thread.

The present invention may be embodied in other forms without departing from the spirit and the essential attributes thereof, and, accordingly, reference should be made to the appended claims, rather than to the forgoing specification, as indicated in the scope of the invention.

What is claimed is:

1. A sewing thread comprising:

a plied yarn consisting of;

a first yarn being an aramid yarn having a denier of about 200;

a second yarn being a nylon yarn and having a denier of about 200;

a third yarn being a nylon yarn and having a denier of about 200;

said first, second and third yarns each having a first twist in the "S" direction;

said first, second and third yarns being combined to form said sewing thread having a second twist in the "Z" direction.

2. The sewing thread of claim 1 wherein said sewing thread being dyeable.

3. A sewing thread comprising:

a plied yarn consisting of;

a first yarn being a polyester polyarylate yarn having a denier of about 200;

a second yarn being a nylon yarn having a denier of about 200;

said first and second yarns each having a first twist in the same direction;

said first and second yarns being combined to form said sewing thread having a second twist being in the opposite direction of said first twist.

4. The sewing thread of claim 3 wherein said first twist being in the "S" direction and said second twist being in the "Z" direction.

5. The sewing thread of claim 3 wherein said sewing thread being dyeable.

* * * * *